US006924786B2

(12) United States Patent
Hebiguchi

(10) Patent No.: US 6,924,786 B2
(45) Date of Patent: Aug. 2, 2005

(54) ACTIVE-MATRIX LIQUID CRYSTAL DISPLAY SUITABLE FOR HIGH-DEFINITION DISPLAY, AND DRIVING METHOD THEREOF

(75) Inventor: Hiroyuki Hebiguchi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 85 days.

(21) Appl. No.: 09/870,295

(22) Filed: May 29, 2001

(65) Prior Publication Data

US 2001/0052888 A1 Dec. 20, 2001

(30) Foreign Application Priority Data

May 31, 2000 (JP) ..... 2000-163615

(51) Int. Cl.[7] ..... G09G 3/36
(52) U.S. Cl. ..... 345/103; 345/98; 345/100
(58) Field of Search ..... 345/94–103, 88, 345/93

(56) References Cited

U.S. PATENT DOCUMENTS 5,253,091 A 10/1993 Kimura et al.
5,598,180 A * 1/1997 Suzuki et al. ..... 345/100
5,748,165 A 5/1998 Kubota et al.
5,850,203 A 12/1998 Yamazaki et al.
5,852,428 A * 12/1998 Ishikawa et al. ..... 345/100
5,892,493 A * 4/1999 Enami et al. ..... 345/100
5,903,250 A * 5/1999 Lee et al. ..... 345/100
5,907,314 A * 5/1999 Negishi et al. ..... 345/103
6,020,871 A * 2/2000 Asada ..... 345/98
6,094,243 A * 7/2000 Yasunishi ..... 349/33
6,124,853 A * 9/2000 Palalau et al. ..... 345/212
6,181,312 B1 * 1/2001 Sekine ..... 345/98
6,232,939 B1 * 5/2001 Saito et al. ..... 345/100
6,323,871 B1 * 11/2001 Fujiyoshi et al. ..... 345/88
6,333,729 B1 * 12/2001 Ha ..... 345/98
6,369,791 B1 * 4/2002 Kudo et al. ..... 345/100
6,424,328 B1 * 7/2002 Ino et al. ..... 345/87
6,839,046 B1 * 1/2005 Orisaka et al. ..... 345/98
2001/0003447 A1 * 6/2001 Murai et al. ..... 345/99
2002/0063676 A1 * 5/2002 Murade et al. ..... 345/100

* cited by examiner

*Primary Examiner*—Bipin Shalwala
*Assistant Examiner*—David L. Lewis
(74) *Attorney, Agent, or Firm*—Brinks Hofer Gilson & Lione

(57) ABSTRACT

A liquid crystal display having a plurality of source lines which are each divided into two groups includes a first source driver for applying image signals to a first group of the divided source lines, a second source driver for applying image signals to a second group, a first gate driver operative to apply scanning signals to one segment of a plurality of gate lines that extends across the first group of the divided source lines, and a second gate driver for applying scanning signals to the other segment of a plurality of gate lines that extends across the second group of the divided source lines. The liquid crystal display further includes 3:1 demultiplexers to switch and allocate an image signal from each of the first and second source drivers to three source lines.

24 Claims, 3 Drawing Sheets

ACTIVE-MATRIX LIQUID CRYSTAL DISPLAY SUITABLE FOR HIGH-DEFINITION DISPLAY, AND DRIVING METHOD THEREOF

BACKGROUND OF THE INVENTION

1. Field of the Invention

The present invention generally relates to a liquid crystal display and a driving method thereof. More particularly, the present invention relates to the configuration of an active-matrix liquid crystal display suitable for high-definition display.

2. Description of the Related Art

In the art of liquid crystal displays (hereinafter sometimes abbreviated as LCDs) for use in a variety of electronic devices, the demand for improved image quality has increased, and high-definition displays have become more and more popular. In particular, in order to address the reduced pixel pitch and increased number of pixels in high-definition display, an LCD using a TFT active-matrix driving method in which a thin film transistor (hereinafter abbreviated as TFT) is used as a switching element in each pixel has been used. In one approach that has been proposed, a plurality of driver ICs allocate and apply image signals to multiple signal lines (source lines) from the upper and lower sides of a display region.

FIG. 3 illustrates an example configuration of a TFT-LCD of this type. An LCD 100 in this example includes a plurality of source lines 102 ($S_1, S_2, \ldots, S_{3m-1}, S_{3m}$) and a plurality of gate lines 103 ($G_1, \ldots, G_n$) arranged in a matrix on a display region 101. Regions defined by the source lines 102 and the gate lines 103 correspond to pixels. A gate driver 104 (driver IC) for applying scanning signals to the gate lines 103 is mounted on the left side of the display region 101 shown in FIG. 3. On the upper and lower sides of the display region 101, source drivers 105 and 106 (driver ICs) for applying image signals to the source lines 102 are mounted, respectively. In this example, the plurality of source lines 102 are grouped into pairs, and source line pairs are alternately connected to the upper and lower source drivers 105 and 106, as shown in FIG. 3. For example, the leftmost pair of source lines 102 is connected to the lower source driver 106, the next horizontal pair of source lines 102 is connected to the upper source driver 105, and so on.

As used herein, the pitch between the adjacent source lines 102 is defined as pixel pitch P. If a single source driver were mounted on either side of a display region to drive all source lines, then the connection pitch between adjacent output terminals of the source driver would be equal to P. In the above-described configuration, however, the connection pitch $P_0$ between adjacent output terminals of the source drivers 105 and 106 is approximately expressed as $P_0=2P$ since source line pairs are alternately connected to the source drivers 105 and 106, resulting in a wider connection pitch. The same is true if every other source line is alternately connected to upper and lower source drivers. This configuration facilitates the connection between the source drivers and the source lines even if the pixel pitch is considerably narrow.

For scanning of gate lines, as shown in FIG. 3 which illustrates n gate lines 103, a method (line-sequential driving method) of scanning and driving the n gate lines 103 one-by-one is generally employed. If the frame frequency is set at 60 Hz (i.e., the frames are refreshed 60 times per second), a time period during which a TFT connected to one gate line 103 is turned on, namely, the write time to required for an image signal to be written into one pixel, is approximately expressed by $t_0=(1/60)\times(1/n)$.

As is illustrated in FIG. 3, in a conventional and practical configuration, the source lines 102 extend over the display region 101 in the vertical direction. If the parasitic capacitance for each pixel is expressed as C, then the parasitic capacitance of n pixels is loaded on a single source line. That is, the parasitic capacitance $C_0$ of a single source line is found by $C_0=n\times C$.

Now, reference is made to the concept of "ease of writing of image signals at source drivers". In general, the longer the write time, the more easily image signals are written, and the higher the parasitic capacitance in a source line, the less easily image signals are written. In other words, the ease of writing E at source drivers is proportional to the write time t while being inversely proportional to parasitic capacitance C of a source line, and is herein defined as $E=t/C$. This equation therefore corresponds to $E_0=t_0/C_0$ in the conventional liquid crystal display shown in FIG. 3.

As previously described, recent TFT-LCDs have been incorporated in high-definition displays, thereby increasing the pixel density (the number of pixels per unit length or per unit area). The higher the pixel density, the narrower the pixel pitch, leading to a narrower connection pitch between drivers and LCD signal lines, thus making it difficult to connect therebetween. In particular, the pitch between source lines is inherently narrower than that between gate lines, and this problem is more noticeable. Such a configuration, in which multiple source lines are allocated to two source drivers, is fast approaching the upper limit of fabrication and connection technology.

Furthermore, increasing the number of pixels throughout the display reduces the write time per pixel while simultaneously increasing the parasitic capacitance on a single source line, thus reducing the ease of writing the image signals. Hence, the source drivers suffer from insufficient throughput and insufficient ability to drive electric current. Therefore, another problem exists in that more sophisticated and more expensive source drivers are required.

SUMMARY OF THE INVENTION

Accordingly, in view of the foregoing problems, it is an object of the present invention to provide a liquid crystal display that enhances the connection between source drivers and LCD signal lines and increases the ease of writing of image signals even if the pixel density is increased, and to provide a driving method thereof.

To this end, in one aspect of the present invention, a liquid crystal display has a pair of substrates which face each other and a liquid crystal is held therebetween. The liquid crystal display includes a plurality of source lines and a plurality of gate lines arranged in a matrix on one of the pair of substrates, the plurality of source lines each being divided into two groups in the direction of extension of the source line. The liquid crystal display further includes a first source driver to apply image signals to one group of the divided source lines, a second source driver to apply image signals to the other group of the divided source lines, a first gate driver to apply scanning signals to the plurality of gate lines that extend across the one group of the divided source lines, and a second gate driver to apply scanning signals to the plurality of gate lines that extend across the other group of the divided source lines. The liquid crystal display further includes a switching unit to switch and allocate an image signal from each of the first and second source drivers to a predetermined number of source lines.

The thus constructed liquid crystal display satisfies the connection pitch and ease of writing requirements in view of the following points.

The liquid crystal display includes a first gate driver which handles gate lines which extend across one of two groups into which source lines are divided, and a second gate driver which handles gate lines which extend across the other group of the divided source lines, but does not include the above-described switching unit. If the first and second gate drivers simultaneously scan the gate lines, then the write time $t_1$ required for a signal to be written in one pixel is two times longer than the write time $t_0$ of a conventional liquid crystal display having n gate lines to be scanned, as shown in FIG. 3, such that $t_1=(1/60)\times(2/n)=2t_0$.

Since the source lines are divided into two groups, the number of pixels (the number of gate lines) on a single source line is expressed as n/2. If the parasitic capacitance per pixel is indicated as C, then the parasitic capacitance $C_1$ of a single source line is found by $C_1=(n/2)\times C=(1/2)\times C_0$, which is reduced to half that of the conventional device.

Therefore, the ease of writing $E_1$ at the source drivers is given by $E_1=t_1/C_1=4E_0$, which is improved by a factor of four over that of the conventional device.

With respect to the connection pitch, however, a liquid crystal display having no switching unit requires the number of outputs of the source drivers which is equal to the number of source lines, i.e., the connection pitch $P_1$ equal to the pixel pitch P. This results in connection pitch $P_1$ which is reduced to half the connection pitch $P_0$ of the conventional device shown in FIG. 3, thus, making it more difficult to connect between the source drivers and the source lines and is not practical for LCDs having high pixel density.

Accordingly, a liquid crystal display of the present invention includes a switching unit to switch and distribute an image signal from each of the source drivers to a predetermined number of source lines. This requires a smaller number of outputs of source drivers than the number of source lines, thereby making the connection pitch $P_1$ equal to or less than the connection pitch $P_0$ of the conventional device shown in FIG. 3.

However, a switching unit temporally allocates a signal from an output of a source driver to a plurality of source lines, thus reducing the write time per pixel. As previously described, the ease of writing $E_1$ at source drivers of a liquid crystal display which does not include a switching unit is improved by a factor of four over that of the conventional device. However, a liquid crystal display including a switching unit provides lower ease of writing than the ease of writing $E_1$ as a signal is allocated to a larger number of source lines, and may provide even lower ease of writing than that of the conventional device if the number of source lines is increased by a large amount. Accordingly, the number of source lines allocated to a switching unit may be appropriately set to realize an LCD which satisfies requirements on both the ease of writing of signals and the ease of connection between source drivers and source lines.

Preferably, the number of source lines allocated to the switching unit is 2 to 4. Three source lines are more preferable, as will be described in detail.

In another aspect of the present invention, there is provided a driving method of a liquid crystal display having a switching unit for switching and allocating an image signal from each of first and second source drivers to three source lines. Image signals having inverse polarities are output from adjacent outputs of the first and second source drivers.

Therefore, dot reverse driving source drivers are used to easily achieve dot reverse driving with less cross-talk.

DESCRIPTION OF THE PREFERRED EMBODIMENTS

One embodiment of the present invention is described with reference to FIGS. 1 and 2.

Figure 1:
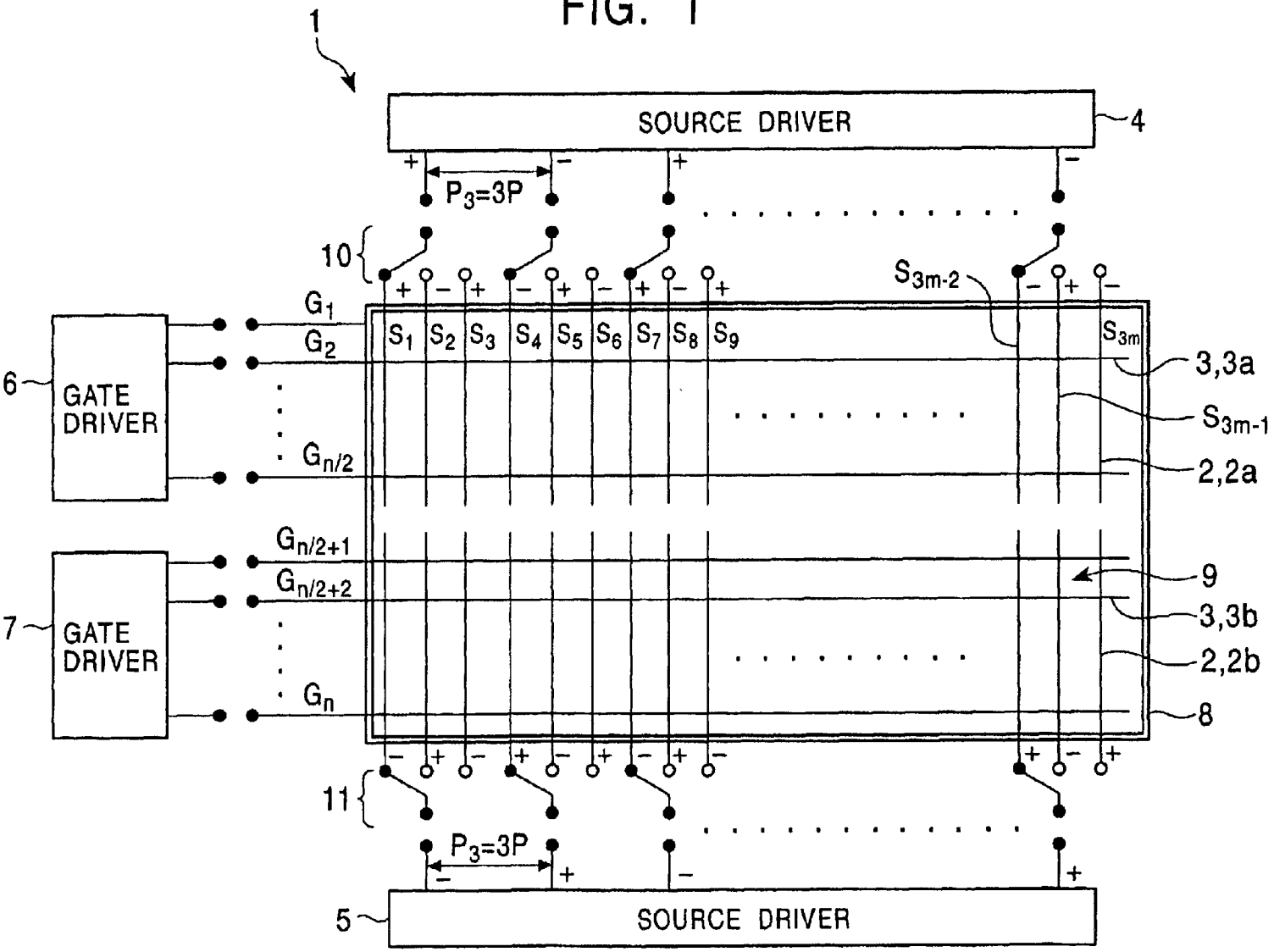
FIG. 1 is a schematic view of a liquid crystal display according to one embodiment of the present invention.

FIG. 1 schematically shows a TFT active-matrix liquid crystal display 1 according to an embodiment of the present invention. The liquid crystal display 1 includes a first source driver 4, a second source driver 5, a first gate driver 6, and a second gate driver 7.

The liquid crystal display 1 has a plurality of source lines 2 ($S_1$, $S_2$, . . . , $S_{3m-1}$, $S_{3m}$) and a plurality of gate lines 3 ($G_1$, . . . , $G_n$) arranged in a matrix on a display region 8. Regions defined by the source lines 2 and the gate lines 3 correspond to pixels. Each of the pixels includes a TFT and a pixel electrode although the components are not shown. The source lines 2 and gate lines 3 may be formed from any conducting material, preferably a metal such as Al if an opaque material is desired or InSnO if an optically transparent material is desired.

The plurality of source lines 2 are each divided into two groups in the direction of extension of the source line 2. Image signals are applied from the first source driver 4 to a first group 2*a* (the upper group in FIG. 1) of the divided source lines 2. Image signals are also applied from the second source driver 5 to a second group 2*b* (the lower group in FIG. 1). The first gate driver 6 operates to apply scanning signals to one segment of the plurality of gate lines 3*a* (in the illustrated example, $G_1$ to $G_{n/2}$) which extends across the first group 2*a* of the divided source lines 2. The second gate driver 7 operates to apply scanning signals to the other segment of the plurality of gate lines 3*b* (in the illustrated example, $G_{n/2+1}$ to $G_n$) which extends across the second group 2*b* of the divided source lines 2. The number of scanning signals applied by each of the gate drivers 6, 7 do not have to be divided equally, however.

The liquid crystal display 1 further includes a demultiplexer 10 between the first source driver 4 and the first source line group 2*a*, and a demultiplexer 11 between the second source driver 5 and the second source line group 2*b*. The demultiplexer 10 switches and allocates an image signal output from the source driver 4 to a predetermined number of the source lines 2*a*, and the demultiplexer 11 switches and allocate an image signal output from the source driver 5 to a predetermined number of source lines 2*b*. In the illustrated embodiment, an image signal output from the source driver 4 is allocated to three adjacent source lines 2*a*, and an image signal output from the source driver 5 is allocated to three adjacent source lines 2*b*. In the following description, a demultiplexer of this type is referred to as a 3:1 demultiplexer. The demultiplexers 10, 11 may be any demultiplexer known in the art of multiplexing and demultiplexing signals.

The first and second source drivers 4 and 5 according to the illustrated embodiment are dot reverse driving source drivers each having adjacent output terminals from which image signals having inverse polarities are output. The 3:1 demultiplexers 10 and 11 are designed so that substantially simultaneous selection is performed for all groups of three (triples) of the source lines 2*a* and 2*b* such that one of the left, center, and right source lines of each triple is selected at substantially the same time. The first and second gate drivers 6 and 7 independently scan the gate lines 3*a* and 3*b*, respectively. For example, scanning of the first gate driver 6 proceeds from the gate lines $G_1$ to $G_{n/2}$, i.e., downward from the top in FIG. 1, and at substantially the same time scanning of the second gate driver 7 proceeds from the gate lines $G_n$ to $G_{n/2+1}$, i.e., upward from the bottom in FIG. 1. That is, the gate lines $G_1$ and $G_n$ are turned on at substantially the same time, and the gate lines $G_{n/2}$ and $G_{n/2+1}$ are turned on at substantially the same time.

This scanning method, which is substantially symmetric, makes the image boundary between the upper and lower portions of the display region 8 less pronounced. However, the scanning method is not restricted to this method, and any other scanning method may be utilized. An example of another scanning method, which is also substantially symmetric, is the first gate driver 6 proceeds from the gate lines $G_1$ to $G_{n/2}$, while the second gate driver 7 proceeds from the gate lines $G_{n/2+1}$ to $G_n$.

The manner of selecting the desired number of source lines to which an image signal from one output of the demultiplexers 10 and 11 is allocated is described below.

A liquid crystal display having no demultiplexer in which source lines are divided into two groups, which are then coupled to separate source drivers, has been previously described in the "SUMMARY OF THE INVENTION" section. That is, in the present invention, the write time $t_1$ is two times longer than that in the conventional device, and the parasitic capacitance $C_1$ of a source line is reduced to half that of the conventional device, thus improving the ease of writing $E_1$ at source drivers by a factor of four over the conventional device. However, since the connection pitch $P_1$ is reduced to half that of the conventional device, connection between the source drivers and the source lines may be difficult.

Figure 2:
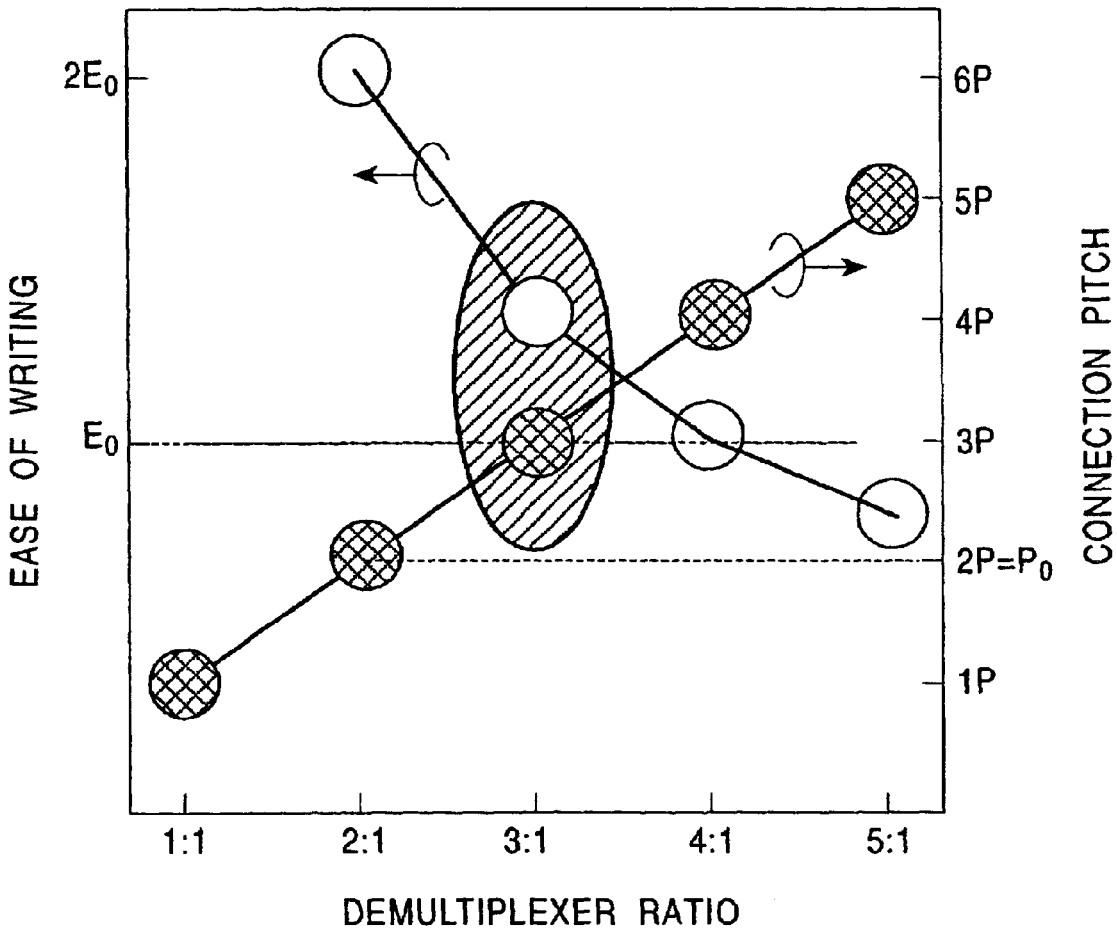
FIG. 2 is a graph showing the relationship of the demultiplexer ratio relative to the ease of writing and the connection pitch.

FIG. 2 depicts the relationship of the demultiplexer ratio relative to the ease of writing and the connection pitch. As used herein, the demultiplexer ratio is defined as "the ratio of the number of source lines corresponding to one output of a demultiplexer to one output". In FIG. 2, the ease of writing at source drivers is indicated by the white or unshaded circles, and the connection pitch is indicated by the shaded circles. A dotted line at level $E_0$ of the ease of writing and another dotted line at level $2P=P_0$ of the connection pitch indicate conventional levels, and superiority of the conventional device is represented by area above the dotted lines.

The above-described liquid crystal display that does not include a demultiplexer is equivalent to a liquid crystal display having 1:1 demultiplexers. At a demultiplexer ratio 1:1, the ease of writing is indicated as $4E_0$ (although not shown in FIG. 2), which is much higher than the conventional device; however, the connection pitch 1P, i.e., half the conventional level, which is inferior to the conventional device.

If 2:1 demultiplexers are used, the required number of outputs of the source drivers may be half the number of source lines, and the connection pitch $P_2$ is two time wider than the pixel pitch P, which is equivalent to the conventional pitch $P_0$, i.e., $P_0=2P$. Since the signal lines are divided into two groups, the parasitic capacitance $C_2$ is expressed by $C_2=C_1=(1/2)\times C_0$, similarly to the above case of 1:1 demultiplexers, while the write time is calculated by $t_2=(1/2)\times t_1=t_0$ due to the 2:1 demultiplexers. The ease of writing $E_2$ is thus given by $E_2=t_2/C_2=2E_0$. Therefore, this configuration may improve the ease of writing to be two times higher than the conventional device while maintaining the connection pitch at the conventional level.

If 4:1 demultiplexers are used, the required number of outputs of the source drivers may be one quarter the number of source lines, and the connection pitch $P_4$ is increased by a factor of four over the pixel pitch P, which is two times wider than the conventional device. Similarly to the above case of 2:1 demultiplexers, the parasitic capacitance $C_4$ is expressed by $C_4=C_2=(1/2)\times C_0$, while the write time is calculated by $t_4=(1/4)\times t_1=(1/2)\times t_0$ due to the 4:1 demultiplexers. The ease of writing $E_4$ is thus given by $E_4=t_4/C_4=E_0$. Therefore, this configuration may improve the connection pitch to be two times wider than the conventional device while maintaining the ease of writing at the conventional level.

If 3:1 demultiplexers are used, the required number of outputs of the source drivers may be one third the number of source lines, and the connection pitch $P_3$ is increased by a factor of three over the pixel pitch P. The connection pitch $P_3$ is therefore 3/2 wider than the conventional connection pitch $P_0$, i.e., $P_0=2P$, thus providing sufficient connection pitch compared to the conventional device Similarly to the above cases, the parasitic capacitance $C_3$ is expressed by $C_3=C_4=C_2=C_1=(1/2)\times C_0$, which is reduced to half that of the conventional device, while the write time is calculated by $t_3=(1/3)\times t_1=(2/3)\times t_0$ due to the 3:1 demultiplexers. The ease of writing $E_3$ is thus given by $E_3=t_3/C_3=(4/3)\times E_0$. Therefore, this configuration may improve the connection pitch to be 3/2 times wider than the conventional device, while improving the ease of writing to be 4/3 times higher than the conventional device, thereby allowing for an improvement in view of both requirements.

Accordingly, if it is desired to maintain one of the connection pitch or the ease of writing at the conventional level while improving the other over the conventional level, 2:1 demultiplexers or 4:1 demultiplexers would be more preferably employed. If it is desired to improve both the connection pitch and the ease of writing over the conventional level, 3:1 demultiplexers would be more preferably employed.

If a 5:1 or higher ratio of demultiplexers are used, as depicted in FIG. 2, the connection pitch is wider but the ease of writing is below the conventional level. The ease of writing problem still exists if the same source drivers as those in the conventional device are used. However, if sophisticated source drivers having an improved writing ability to overcome the ease of writing problem are introduced and if only the problem of the connection pitch still exists, using a 5:1 or higher ratio of demultiplexers would be meaningful.

Figure 3:
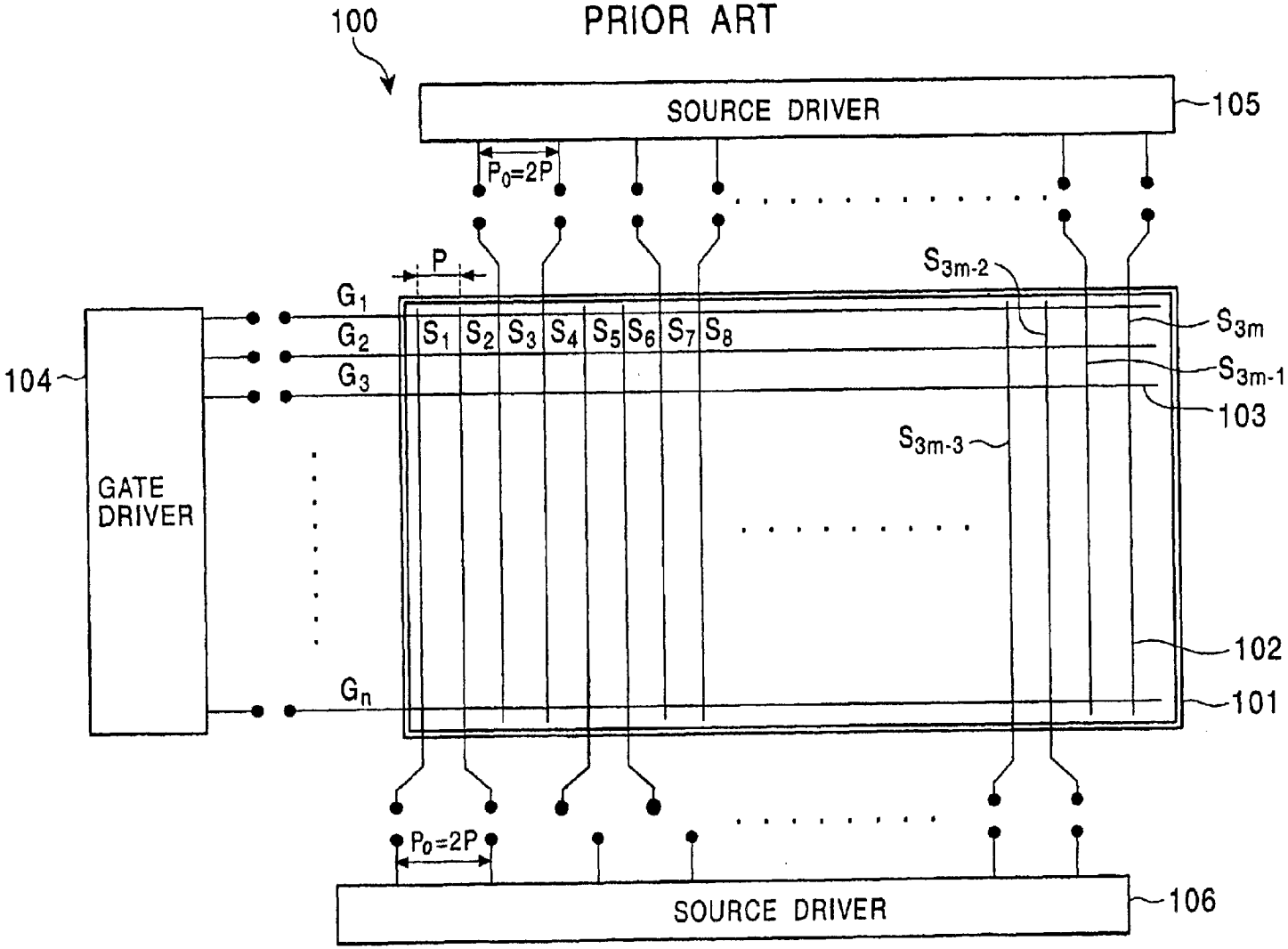
FIG. 3 PRIOR ART
FIG. 3 is a schematic view of an example of a conventional liquid crystal display.

In the liquid crystal display 1 of the illustrated embodiment, therefore, the source lines 2 are divided into two groups, which are then coupled to the first and second source drivers 4 and 5, and the 3:1 demultiplexers 10 and 11 are used, thereby realizing a liquid crystal display having an increased connection pitch and an improved ease of writing compared to the conventional device shown in FIG. 3. As a result, if high-definition display introduces inconvenience such as a reduced pixel pitch and an increased pixel density, a connection between source drivers and source lines is technically possible, and the drivers do not encounter problems such as insufficient writing ability.

In the illustrated embodiment, since the first and second source drivers 4 and 5 are dot reverse driving source drivers, 3:1 demultiplexers would be more convenient for dot reverse driving. Once the 3:1 demultiplexers are designed so that simultaneous selection is performed for all triples of the source lines such that one of the left, center, and right source lines of each triple is selected at the same timing, dot reverse driving is readily performed. If 2:1 demultiplexers or 4:1 demultiplexers are used, the operation of the demultiplexers must be complicated in order to use the same source drivers to achieve the dot reverse driving.

According to the illustrated embodiment, a driving method in which signals from adjacent outputs of the source drivers 4 and 5 have inverse polarities and adjacent source lines 2 have inverse polarities provides a display with a sharp image and less cross-talk. Of course, signals to be written in pixels should have polarities inverted every frame in order to avoid the burn-in phenomenon (image retention).

The technical scope of the present invention is not specifically limited to the illustrated embodiment, and a variety of modifications and changes may be made without departing from the spirit and scope of the invention. For example, the specific description on the details such as the number of source and gate lines across the liquid crystal display, the demultiplexer ratio, the driving method, the number of driver ICs, and the scanning method is not limited to the illustrated embodiment. It will be anticipated by a person skilled in the art that a variety of modifications may be made.

What is claimed is:

1. A liquid crystal display comprising:

a pair of substrates which face each other and a liquid crystal held therebetween;

a plurality of source lines and a plurality of gate lines arranged in a matrix on one of the pair of substrates, the plurality of source lines being divided at least into a first and second group in a direction of extension of the source lines, such that at least one of the source lines does not extend across at least one of the gate lines;

a first source driver to apply image signals to the first group of the divided source lines;

a second source driver to apply image signals to the second group of the divided source lines;

a first gate driver to apply scanning signals to the plurality of gate lines that extend across the first group of the divided source lines;

a second gate driver to apply scanning signals to the plurality of gate lines that extend across the second group of the divided source lines; and a switching unit to switch and allocate image signals from each of the first and second source drivers to a predetermined number of the source lines from the first and second group of the divided source lines, wherein the image signals are applied simultaneously with inverse polarity to a pair of opposing divided source lines; scanning of the first gate driver proceeds downward from the top, and at substantially the same time scanning of the second gate driver proceeds upward from the bottom.

2. A liquid crystal display according to claim 1, wherein the predetermined number of source lines is two to four.

3. A liquid crystal display according to claim 1, wherein the predetermined number of source lines is three.

4. A liquid crystal display according to claim 1, wherein image signals having inverse polarities are applied to adjacent source lines in each of the first and second groups.

5. A liquid crystal display according to claim 1, wherein image signals having inverse polarities are output from opposing outputs of the first and second source drivers.

6. A liquid crystal display according to claim 1, wherein scanning signals are applied substantially symmetrically by each gate driver.

7. A liquid crystal display according to claim 6, wherein the first gate driver applies scanning signals starting from a gate line most proximate to the first source driver and proceeding towards a gate line most distal to the first gate driver.

8. A liquid crystal display according to claim 6, wherein the second gate driver applies scanning signals starting from a gate line most proximate to the second source driver and proceeding towards a gate line most distal to the second gate driver.

9. A liquid crystal display according to claim 6, wherein each scanning signal applied by the first gate driver is substantially simultaneous with the symmetric scanning signal applied by the second gate driver.

10. A method of writing in a liquid crystal display, the method comprising:

selecting two sets of image signals, each image signal selected from a plurality of image signals;

applying each set of image signals at least to a first and second group of divided source lines;

applying scanning signals to a first and second groups of gate lines, each group of gate lines correspondingly extending across the first and second groups of divided source lines such that at least one of the source lines does not extend across at least one of the gate lines;

switching the image signals from each of a first and a second source drivers to a predetermined number of source lines from the first and second groups of divided source lines where the predetermined number is less than a number of source lines in either of the first and second groups;

allocating the image signals from each of the first and the second source drivers to the predetermined number of source lines; and applying the image signals with inverse polarity simultaneously to a pair of opposing divided source; lines scanning of the first gate driver proceeds downward from the top, and at substantially the same time scanning of the second gate driver proceeds upward from the bottom.

11. The method of claim 10, wherein the switching and allocating comprises demultiplexing the image signal from each of the first and second source drivers to the predetermined number of source lines.

12. The method of claim 10, further comprising dividing the source lines into two groups of source lines and the gate lines into two groups of gate lines.

13. The method of claim 10, further comprising applying with image signals with inverse polarity to adjacent source lines in each of the first and the second groups of source lines.

14. The method of claim 10, further comprising applying one scanning signal to one of the two groups of gate lines substantially simultaneously with applying one scanning signal to the other of the two groups of gate lines.

15. The method of claim 14, further comprising applying the scanning signals substantially symmetrically between the two groups of gate lines.

16. The method of claim 14, further comprising applying the scanning signals to the two groups of gate lines such that the substantially simultaneously applied scanning signals progressively approach each other.

17. The method of claim 14, further comprising applying the scanning signals to the two groups of gate lines such that the substantially simultaneously applied scanning signals remain the same distance from each other.

18. The method of claim 10, further comprising balancing a writing time of the image signals on the selected source lines with a capacitance formed at areas of overlap of the source lines and gate lines to provide a desired increase in ease of writing.

19. A liquid crystal display comprising:

a pair of substrates which face each other and a liquid crystal held therebetween;

a plurality of source lines and a plurality of gate lines arranged in a matrix, the plurality of source lines being divided at least into first and second group in a direction of extension of the source lines, such that at least one of the source lines in each group does not extend across at least one of the gate lines;

a first source driver to apply image signals to the first group of the divided source lines;

a second source driver to apply image signals to the second group of the divided source lines;

a first gate driver to apply scanning signals to the plurality of gate lines that extend across the first group of the divided source lines;

a second gate driver to apply scanning signals to the plurality of gate lines that extend across the second group of the divided source lines; and a switching unit to switch and allocate an image signal from each of the first and second source drivers to a predetermined number of the source lines from the first and second groups of the divided source lines, the image signals being applied simultaneously with inverse polarity to at least a pair of divided source lines, wherein the image signals are applied with inverse polarity to adjacent source lines in each of the first and the second groups of source lines scanning of the first gate driver proceeds downward from the top, and at substantially the same time scanning of the second gate drive proceeds upward from the bottom.

20. A liquid crystal display according to claim 19, wherein scanning signals are applied substantially symmetrically by each gate driver.

21. A liquid crystal display according to claim 1, wherein the plurality of gate lines that extend across the one group of the divided source lines do not extend across the other group of the divided source lines.

22. A liquid crystal display according to claim 1, wherein the predetermined number of the source lines is at least the number of the plurality of source lines being divided in the direction of extension of the source lines.

23. A method according to claim 10, wherein the predetermined number of the source lines is at least the number of the plurality of source lines being divided in a direction of extension of the source lines.

24. A liquid crystal display according to claim 19, wherein the predetermined number of the source lines is at least the number of the plurality of source lines being divided in the direction of extension of the source lines.

* * * * *